US012372087B2

(12) United States Patent
Tooley et al.

(10) Patent No.: US 12,372,087 B2
(45) Date of Patent: Jul. 29, 2025

(54) SUPERCHARGER ROTORS FOR INCREASED ENGINE POWER OUTPUT

(71) Applicants: Richard Crawford, Hope Mills, NC (US); Brian Tooley Racing, Inc., Bardstown, KY (US)

(72) Inventors: Brian Keith Tooley, Bardstown, KY (US); Richard Crawford, Hope Mills, NC (US)

(73) Assignee: Brian Tooley Racing, Inc., Bardstown, KY (US)

( * ) Notice: Subject to any disclaimer, the term of this patent is extended or adjusted under 35 U.S.C. 154(b) by 0 days.

(21) Appl. No.: 18/069,687

(22) Filed: Dec. 21, 2022

(65) Prior Publication Data

US 2024/0209856 A1 Jun. 27, 2024

(51) Int. Cl.

| | |
|---|---|
| ***F04C 18/08*** | (2006.01) |
| ***F04C 18/12*** | (2006.01) |
| ***F04C 18/16*** | (2006.01) |
| ***F04C 18/18*** | (2006.01) |

(52) U.S. Cl.
CPC ..... *F04C 18/088* (2013.01); *F04C 18/126* (2013.01); *F04C 18/18* (2013.01); *F04C 2240/20* (2013.01); *F04C 2250/20* (2013.01)

(58) Field of Classification Search
CPC ..... F04C 18/088; F04C 18/126; F04C 18/18; F04C 2240/20; F04C 2250/20
See application file for complete search history.

(56) References Cited

U.S. PATENT DOCUMENTS 2,845,031 A * 7/1958 Guibert ..... F04C 2/088 418/190
4,025,056 A * 5/1977 Miles ..... F04C 2/084 418/206.4

(Continued)

FOREIGN PATENT DOCUMENTS

JP 59176487 A * 10/1984 ..... F04C 27/005
WO WO8500637 A1 * 2/1985 ..... F04C 2/084
WO WO-2019079555 A1 * 4/2019 ..... F02B 33/38

OTHER PUBLICATIONS

JP59176487A—Obata et al.—Rotor of Screw Compressor—Oct. 5, 1984—English Machine Translation. (Year: 1984).*

*Primary Examiner* — Theresa Trieu
(74) *Attorney, Agent, or Firm* — Rutan & Tucker LLP; Hani Z. Sayed; Ravi Mohan

(57) ABSTRACT

An apparatus and methods for a rotor pack are provided for a positive displacement supercharger that produces greater engine power output without loss of best seal between the rotors or between the rotors and an interior surface of an enclosing case. The rotors include relief zones and cupped portions at an intake airflow side of each lobe comprising the rotors. The relief zones allow additional airflow to enter the rotor pack while the cupped portions scoop additional airflow into the rotor pack during operation of the supercharger. Tapered radius portions of an enclosing case allow additional airflow to be dragged into the rotor pack. Pressure relief portions on a rotor bearing plate and angled portions on each lobe extend compression events during operation of the rotor pack. The angled portions reduce a margin of the lobes to sharpened edges without affecting the diameter of the margin.

17 Claims, 4 Drawing Sheets

(56) References Cited

U.S. PATENT DOCUMENTS

| | | | | |
|---|---|---|---|---|
| 4,390,331 | A * | 6/1983 | Nachtrieb | F04C 18/123<br>418/206.5 |
| 5,335,640 | A * | 8/1994 | Feuling | F04C 18/126<br>418/141 |
| 5,350,286 | A * | 9/1994 | Kisi | F04C 18/084<br>418/201.3 |
| 2019/0203708 | A1 * | 7/2019 | Meyers | F04C 2/084 |

* cited by examiner

SUPERCHARGER ROTORS FOR INCREASED ENGINE POWER OUTPUT

FIELD

Embodiments of the present disclosure generally relate to superchargers for internal combustion engines. More specifically, embodiments of the disclosure relate to rotors for positive displacement superchargers that produce greater airflow and engine power output without negatively impacting overall airflow displacement.

BACKGROUND

In general, a supercharger increases the power output of an internal combustion engine. The supercharger increases the amount of air entering the internal combustion engine for combustion of fuel. Superchargers may be categorized as a form of forced induction that is mechanically powered, typically by a belt driven by a crankshaft of the engine. In particular, a positive displacement supercharger intakes air at atmospheric pressure and moves the air into an intake manifold of the engine at a higher pressure. Positive displacement superchargers are known to produce a flat torque curve throughout the engine's operating range and a lag-free throttle response.

One popular type of positive displacement supercharger is a Roots-type supercharger that includes a blower that pumps engine intake air by way of a pair of meshing rotor lobes that resemble a pair of stretched gears rotating within an enclosing case. A drawback to the Roots-type supercharger is that air flow tends to move in bursts, rather than smoothly and continuously as with, for example, a centrifugal supercharger compressor.

Over the years, positive displacement supercharger rotor packs have held to design criteria that keep tight tolerances between the rotors and an interior surface of the case as well as areas where the rotors interact with each other to maintain "best seal" where the rotors open, "induction event," and close, "compression/displacement event," creating an optimal pressure differential during opening/closing events. Due to adhering to these criteria, aerodynamic principles have not been applied to transition edges of the rotors in design and production processes. Testing has shown, however, that airflow losses in rotor cavity "fill" due to poor aerodynamic design is generally greater than losses between the rotors as well as losses between the rotors and the enclosing case. Given that engine manufacturers are always seeking ways to increase the power output of their engines while maintaining reliability and fuel efficiency, there is a continuous desire to improve the operation of positive displacement superchargers.

SUMMARY

An apparatus and methods for a rotor pack are provided for a positive displacement supercharger that produces greater engine power output without loss of best seal between the rotors or between the rotors and an interior surface of an enclosing case. The rotors include relief zones and cupped portions at an intake airflow side of each lobe comprising the rotors. The relief zones allow additional airflow to enter the rotor pack while the cupped portions scoop additional airflow into the rotor pack during operation of the supercharger. Tapered radius portions of an enclosing case allow additional airflow to be dragged into the rotor pack. Pressure relief portions on a rotor bearing plate and angled portions on each lobe extend compression events during operation of the rotor pack. The angled portions reduce a margin of the lobes to sharpened edges without affecting the diameter of the margin.

In an exemplary embodiment, a rotor pack for a supercharger comprises: a first rotor and a second rotor that include meshed lobes; a shaft supporting each of the first rotor and the second rotor within an enclosing case; and a relief zone disposed at an intake airflow side of each lobe.

In another exemplary embodiment, the relief zone is configured to allow additional airflow to enter the rotor pack. In another exemplary embodiment, the relief zone comprises a curved surface that includes a line of curvature. In another exemplary embodiment, the line of curvature is tangent to a flat end face of the lobes and is tangent to a trailing surface of the lobe. In another exemplary embodiment, the relief zone extends from a termination of a radial blend prior to a compression zone to a termination of a radial seal of the lobe. In another exemplary embodiment, the compression zone comprises a valley that is disposed between adjacent pairs of lobes comprising each of the first rotor and the second rotor.

In another exemplary embodiment, the rotor pack further includes a cupped portion comprising an intake side of each of the first rotor and the second rotor. In another exemplary embodiment, the cupped portion comprises a triangular-shaped region disposed on a leading surface of each lobe. In another exemplary embodiment, the cupped portion comprises a sharpened leading edge that transitions into flattened region of each lobe. In another exemplary embodiment, the flattened region extends to a trailing surface of each lobe. In another exemplary embodiment, the sharped leading edge and the flattened region are configured to scoop additional airflow into a rotor cavity during operation of the first rotor and the second rotor.

In another exemplary embodiment, the cupped portion comprises a roughly 1.0 square inch area of the leading surface. In another exemplary embodiment, the cupped portion comprises a roughly 1.0-inch sharpened leading edge of the lobe. In another exemplary embodiment, the cupped portion includes a longitudinal distance of about 1.0 inch along a radial seal edge of the lobe.

In another exemplary embodiment, the rotor pack further includes an angled portion disposed on each lobe adjacent to a rotor bearing plate. In another exemplary embodiment, the angled portion is disposed between a trailing surface and a flat face of the lobe. In another exemplary embodiment, the angled portion reduces a margin of the lobe to a sharpened edge without affecting the overall diameter of the margin.

In another exemplary embodiment, the angled portion comprises a flat surface that is disposed at roughly 30-degrees relative to the flat face of the lobe. In another exemplary embodiment, the angled portion extends a longitudinal distance of approximately 0.500 inches into the trailing surface. In another exemplary embodiment, the angled portion extends a radial distance ranging up to 0.750 inches into the flat face of the lobe.

In another exemplary embodiment, the rotor pack further includes a pressure relief portion comprising a rotor bearing plate and configured to extend a compression event during operation of the rotor pack. In another exemplary embodiment, the pressure relief portion is configured to direct air out from between the first rotor and the second rotor in an efficient manner that minimizes turbulence. In another exemplary embodiment, the pressure relief portion is configured to relieve pressure from between the first rotor and the second rotor. In another exemplary embodiment, the pressure relief portion is configured to improve airflow away from the rotors pack during the compression event.

In another exemplary embodiment, the rotor pack further includes tapered radius portions comprising the enclosing case that are configured to allow additional airflow into between first rotor and the second rotor. In another exemplary embodiment, the tapered radius portion are configured to allow air that is dragged by the first rotor and the second rotor to enter between the first rotor and the second rotor.

These and other features of the concepts provided herein may be better understood with reference to the drawings, description, and appended claims.

BRIEF DESCRIPTION OF THE DRAWINGS

The drawings refer to embodiments of the present disclosure in which.

Figure 1:
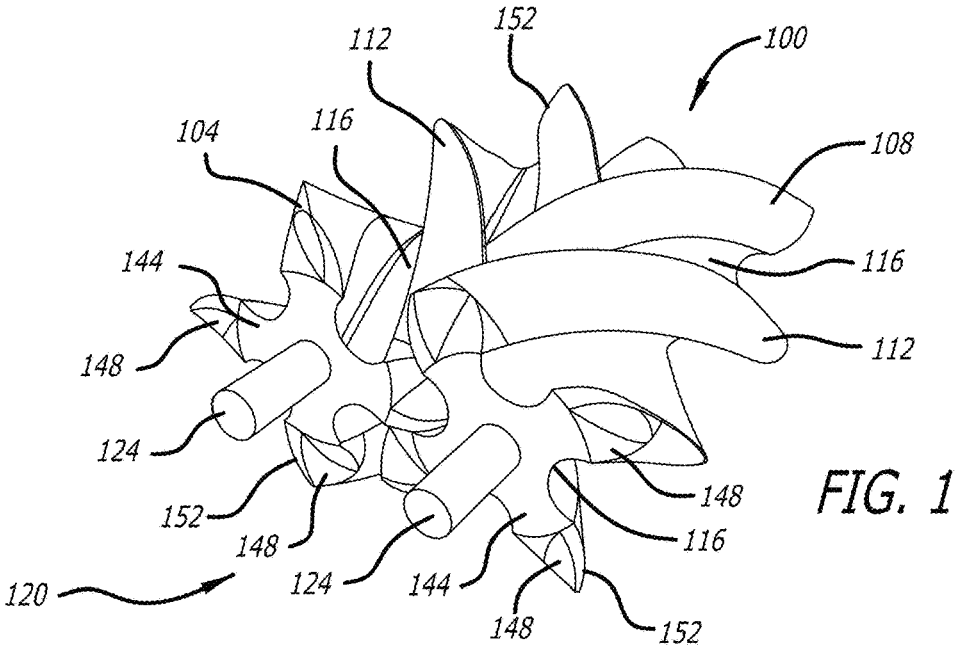
FIG. 1 illustrates a perspective view of an exemplary embodiment of a rotor pack for a positive displace supercharger, according to the present disclosure.

While the present disclosure is subject to various modifications and alternative forms, specific embodiments thereof have been shown by way of example in the drawings and will herein be described in detail. The present disclosure should be understood to not be limited to the particular forms disclosed, but on the contrary, the intention is to cover all modifications, equivalents, and alternatives falling within the spirit and scope of the present disclosure.

DETAILED DESCRIPTION

In the following description, numerous specific details are set forth in order to provide a thorough understanding of the present disclosure. It will be apparent, however, to one of ordinary skill in the art that the supercharger rotors and methods disclosed herein may be practiced without these specific details. In other instances, specific numeric references such as "first rotor," may be made. However, the specific numeric reference should not be interpreted as a literal sequential order but rather interpreted that the "first rotor" is different than a "second rotor." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about." "approximately," or "substantially" for any numerical values or ranges indicate a suitable dimensional tolerance that allows the part or collection of components to function for its intended purpose as described herein.

One popular type of positive displacement supercharger is a Roots-type supercharger that includes a blower that pumps engine intake air by way of a pair of meshing rotor lobes that resemble a pair of stretched gears rotating within an enclosing case. A drawback to the Roots-type supercharger is that air flow tends to move in bursts, rather than smoothly and continuously. In an attempt to "best seal" where the rotors open and close, aerodynamic principles have not been applied to transition edges of the rotors in design and production processes. Testing has shown, however, that airflow losses in rotor cavity "fill" due to poor aerodynamic design is generally greater than losses between the rotors as well as losses between the rotors and the enclosing case. Embodiments presented herein provide rotors for positive displacement superchargers that produce greater airflow and engine power output without negatively impacting overall airflow displacement.

FIG. 1 illustrates a perspective view of an exemplary embodiment of a supercharger rotor pack 100, according to the present disclosure. The rotor pack 100 comprises a first rotor 104 and a second rotor 108 that include meshed lobes 112 resembling a pair of twisted gears. The rotors 104, 108 rotate in opposite directions such that the meshed lobes 112 push intake air into an intake manifold of an internal combustion engine. As shown in FIG. 1, each pair of adjacent lobes 112 is separated by an intervening valley 116. During rotation of the rotors 104, 108, each pair of meshed lobes 112 and the intervening valley 116 comprise a cavity that moves away, or is displaced, from an intake airflow side 120 of the rotor pack 100 and opens into a compression side that leads to the intake manifold.

Figure 2:
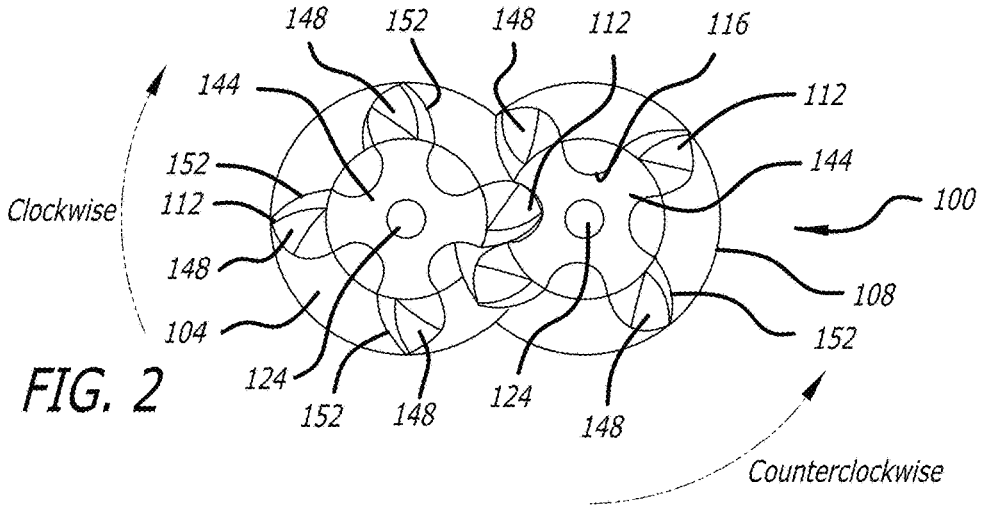
FIG. 2 illustrates a front view of an intake airflow side of the rotor pack of FIG. 1 in accordance with the present disclosure.
Figure 8:
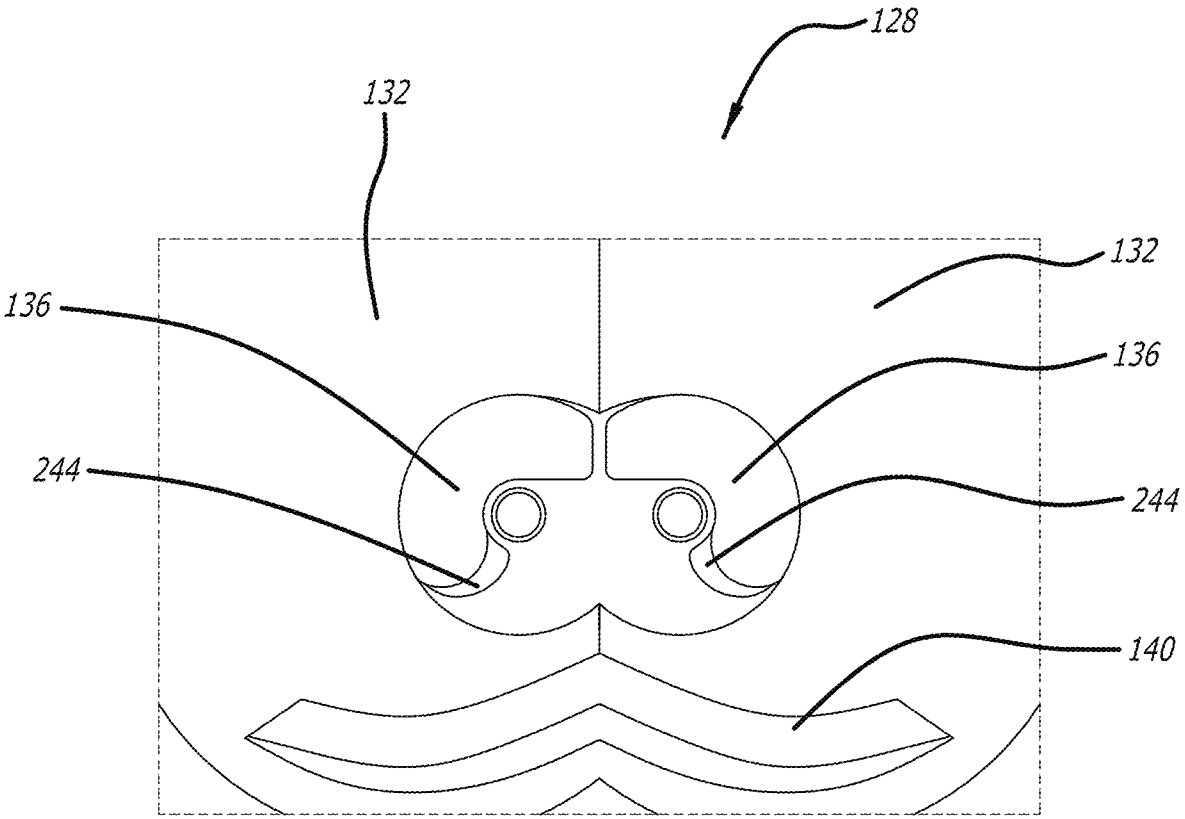
FIG. 8 illustrates an exemplary embodiment of an enclosing case including tapered radius portions configured to allow additional airflow into a rotor pack, in accordance with the present disclosure.

As shown in FIGS. 1-2, the rotors 104, 108 ride on shafts 124 such that lobes 112 on one rotor enter the valleys 116 on the other rotor. In general, the shafts 124 are supported by bearings disposed in an enclosing case 128 (see FIG. 8) such that the rotors 104, 108 counterrotate within an interior cylindrical surface 132 of the case 128. As shown in FIG. 8, the case 128 includes intake ports 136 configured to supply intake air to the rotors 104, 108. A compression port 140 comprising the case 128 provides an exit for compressed air from the rotor pack 100 into the intake manifold.

Figure 3:
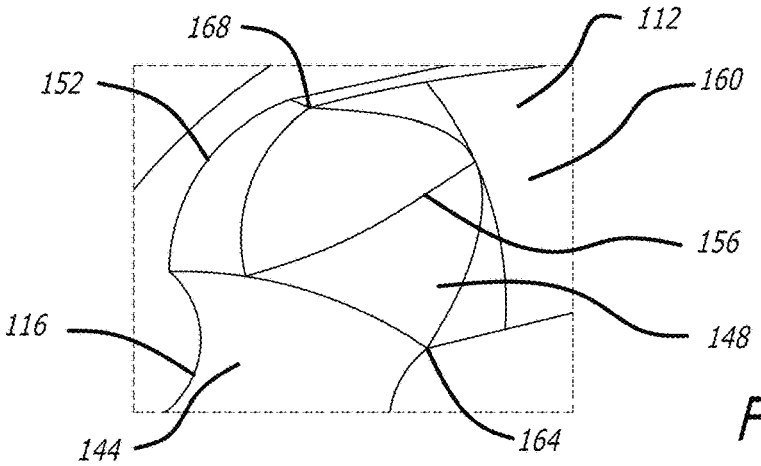
FIG. 3 illustrates a close-up view of an exemplary embodiment of a relief zone comprising an intake airflow side of the rotor pack of FIG. 1, according to the present disclosure.

As shown in FIGS. 1-3, the rotors 104, 108 include flat end faces 144. The end faces 144 abut interior surfaces of the case 128 so as to form a best seal that operates to prevent compressed air from migrating out of the intake manifold during rotation of the rotor pack 100. A relief zone 148 is disposed at the intake airflow side of each lobe 112. It is contemplated that the relief zones 148 allow additional airflow to enter between the meshed lobes 112 rather than the airflow being abruptly severed by leading edges 152 of the lobes 112 as the lobes become meshed.

FIG. 3 illustrates a close-up view of an exemplary embodiment of a relief zone 148 comprising an intake side of the supercharger rotor pack 100 of FIG. 1, according to the present disclosure. In the illustrated embodiment, the relief zone 148 comprises a curved surface that includes a line of curvature 156 that is tangent to the flat end face 144 as well as tangent to a trailing surface 160 of the lobe 112.

Further, the relief zone 148 extends from a point 164 to a point 168. Those skilled in the art will recognize that point 164 comprises the termination of a radial blend prior to the valley 116 (e.g., "compression zone") while point 168 comprises the termination of a radial seal of the rotor. Experimental observation has demonstrated that the relief zones 148 give rise to substantially a 5% increase in engine power output. It should be borne in mind that the relief zones 148 may be varied from the specific shape and size shown and described herein, without limitation, and without deviating beyond the spirit and scope of the present disclosure.

Figure 4:
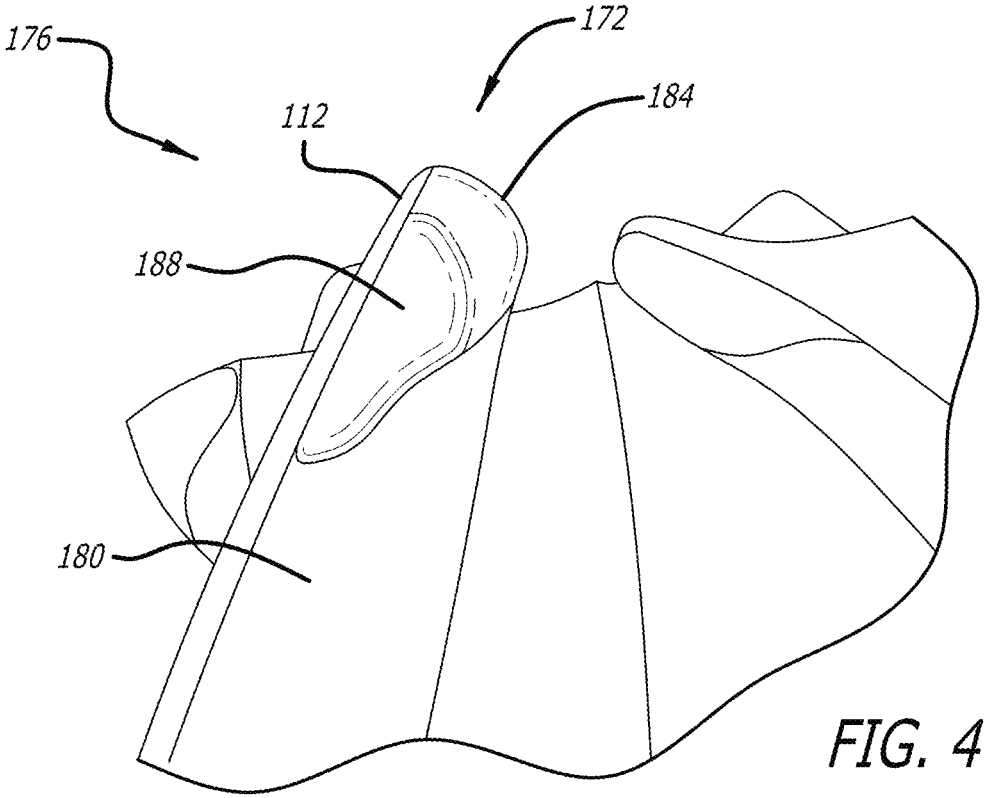
FIG. 4 illustrates a close-up view of an exemplary embodiment of a rotor lobe including a triangular-shaped curved portion in accordance with the present disclosure.
Figure 5:
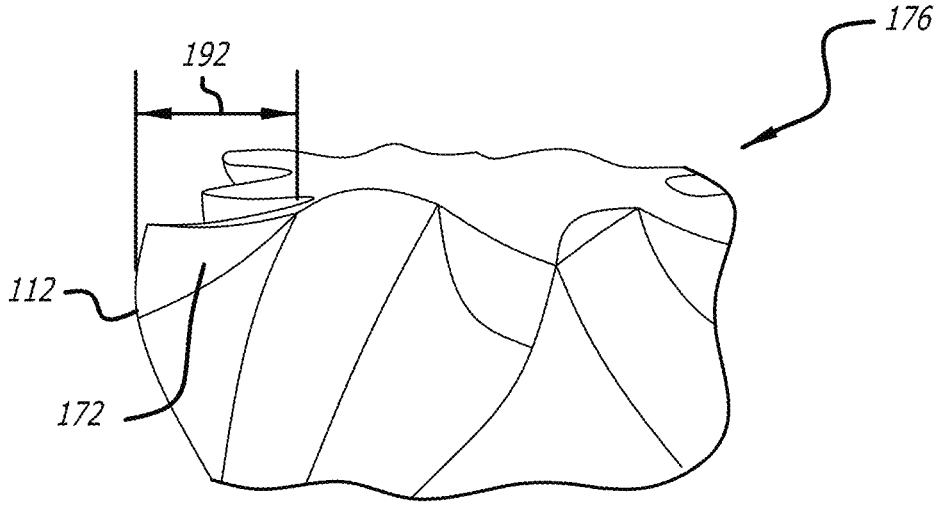
FIG. 5 illustrates an exemplary embodiment of a radial distance of the curved portion of FIG. 4, according to the present disclosure.
Figure 6:
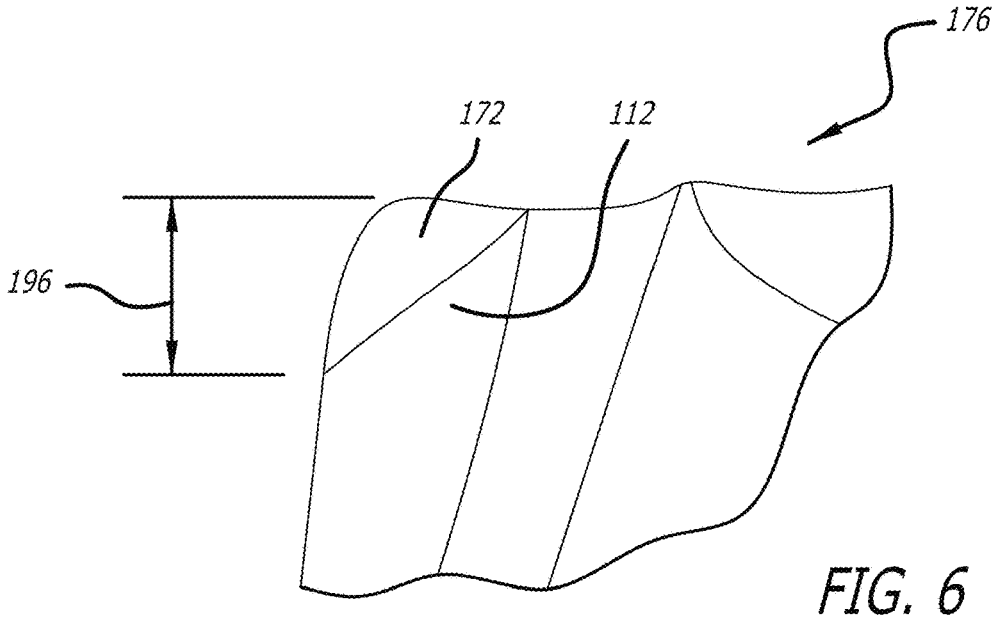
FIG. 6 illustrates an exemplary embodiment of a longitudinal distance of the curved portion of FIG. 4, according to the present disclosure.

FIGS. 4-6 illustrate close-up views of an exemplary embodiment of a cupped portion 172 comprising an intake side of a supercharger rotor pack 176 in accordance with the present disclosure. The cupped portion 172 comprises a triangular-shaped region disposed on a leading surface 180 of each of the lobes 112 comprising the rotor pack 176. As shown in FIG. 4, the cupped portion 172 comprises a sharpened leading edge 184 that transitions into flattened region 188 of the lobes 112. In some embodiments, the flattened regions 188 may extend to a trailing surface 160 (see FIG. 3) of the lobe 112. The sharped leading edge 184 and the flattened region 188 are configured to scoop additional airflow into the rotor cavity during operation of the rotor pack 176. It is contemplated that sharpening the leading edge 184 and flattening region 188 of the leading surface 180 gives rise to greater airflow being moved by the rotor pack 176.

In one embodiment, the cupped portion 172 comprises a roughly 1.0 square inch area of the leading surface 180. In an embodiment illustrated in FIG. 5, the cupped portion 172 includes a radial distance 192 of about 1.0 inch along the lobe 112. As such, in the embodiment of FIG. 5, the lobe 112 includes a 1.0-inch sharpened leading edge 184. In an embodiment illustrated in FIG. 6, the cupped portion 172 includes a longitudinal distance 196 of about 1.0 inch along a radial seal edge of the lobe 112. It is contemplated that the distances 192, 196, as well as the degree of flattening of the region 180 may be varied without limitation, and without straying beyond the spirit and scope of the present disclosure.

Figure 7:
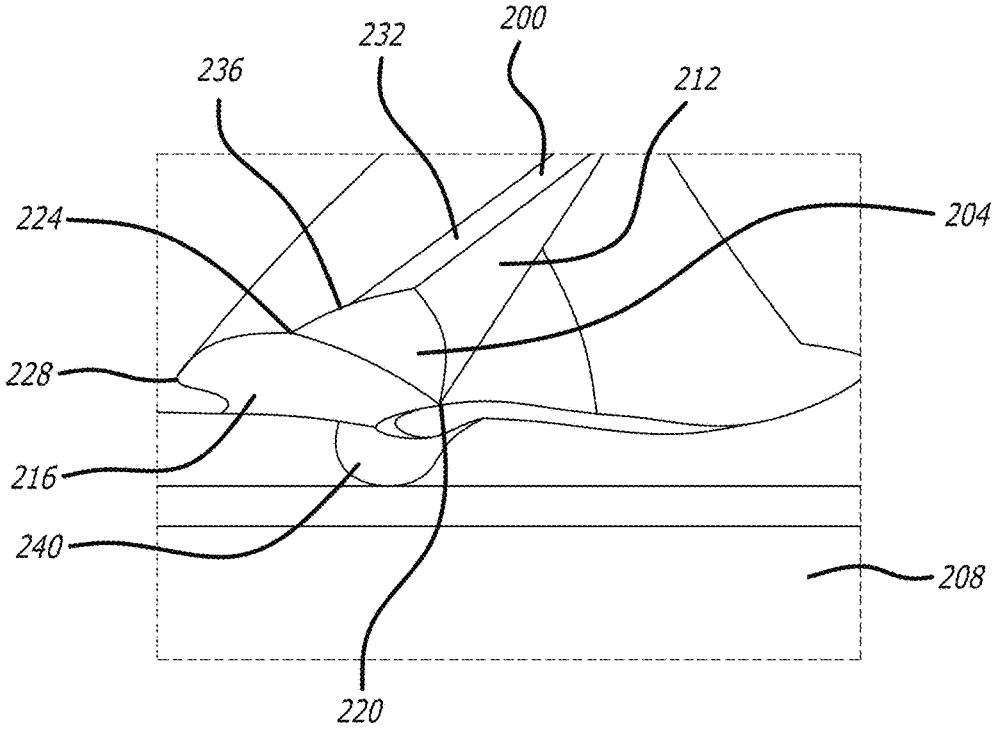
FIG. 7 illustrates a close-up view of an exemplary embodiment of a rotor lobe including an angled portion disposed adjacent to a rotor bearing plate that includes a pressure relief portion, in accordance with the present disclosure.

FIG. 7 illustrates a close-up view of an exemplary embodiment of a rotor lobe 200 including an angled portion 204 disposed adjacent to a rotor bearing plate 208, in accordance with the present disclosure. Those skilled in the art will recognize that the rotor bearing plate 208 generally includes gears configured to drive the counterrotating, meshed rotors, as described herein. As shown in FIG. 7, the angled portion 204 is disposed between a trailing surface 212 and a flat face 216 of the rotor lobe 200. More specifically, the angled portion 204 comprises a bevel that begins at a point 220 on the trailing surface 212 and extends to a point 224 on a leading edge 228. The angled portion 204 reduces a margin 232 of the rotor lobe 200 to a sharpened edge 236 without affecting the overall diameter of the margin 232.

In some embodiments, the angled portion 204 comprises a flat surface that is disposed at roughly 30-degrees relative to the flat face 216. In some embodiments, the angled portion 204 extends a longitudinal distance of approximately 0.500 inches into the trailing surface 212. Further, in some embodiments, the angled portion 204 extends a radial distance ranging up to 0.750 inches into the flat face 216. It should be borne in mind that the specific distances as well as the angle of the angled portion 204 may be varied without deviating beyond the scope of the present disclosure.

With continuing reference to FIG. 7, an exemplary embodiment of a pressure relief portion 240 of the rotor bearing plate 208 is illustrated in accordance with the present disclosure. In general, the pressure relief portion 240 is configured to extend the compression event during operation of the supercharger rotor pack. Conventional rotor bearing plates (e.g., bearing plates lacking the pressure relief portion 240) cover the cavity between the counterrotating rotors, such as the rotors 104, 108 (see FIGS. 1-3), before the compression event is completed. As such, the pressure relief portion 240 is radiused and tapered so as to direct air out from between the rotors 104, 108 and toward the discharge area in an efficient manner that minimizes turbulence. The pressure relief portion 240 relieves pressure from between the rotors 104, 108 that would otherwise give rise to drag and reduced airflow. Experimental observation has demonstrated that the pressure relief portion 240 aids in moving air away from the counterrotating rotors 104, 108 during the compression event.

Turning, now, to FIG. 8, an exemplary embodiment of an enclosing case 128 that includes tapered radius portions 244 is shown in absence of the rotors 104, 108 (see, for example, FIGS. 1-3). The tapered radius portions 244 are configured to allow additional airflow into a cavity between the rotors 104, 108. As described herein, the rotors 104, 108 include shafts 124 that are supported by bearings disposed in the enclosing case 128 such that the rotors 104, 108 counterrotate within an interior cylindrical surface 132 of the case 128. As shown in FIG. 8, the case 128 includes intake ports 136 that supply intake air to the rotors 104, 108. While the rotors 104, 108 turn, air is dragged in the direction of rotation of each rotor. The tapered radius portions 244 allow the air that is dragged by the rotors 104, 108 to enter the cavity between the rotors instead of being sheared off by the lobes 112 passing the sharp edges of the intake ports 136.

While the supercharger rotors and methods have been described in terms of particular variations and illustrative figures, those of ordinary skill in the art will recognize that the supercharger rotors are not limited to the variations or figures described. In addition, where methods and steps described above indicate certain events occurring in certain order, those of ordinary skill in the art will recognize that the ordering of certain steps may be modified and that such modifications are in accordance with the variations of the supercharger rotors. Additionally, certain of the steps may be performed concurrently in a parallel process, when possible, as well as performed sequentially as described above. To the extent there are variations of the supercharger rotors, which are within the spirit of the disclosure or equivalent to the supercharger rotors found in the claims, it is the intent that this patent will cover those variations as well. Therefore, the present disclosure is to be understood as not limited by the specific embodiments described herein, but only by scope of the appended claims.

What is claimed is:

1. A supercharger rotor pack, comprising:

a first rotor and a second rotor that include meshed lobes and flat end faces that abut interior surfaces of a case to form a seal that prevents compressed air from migrating out of an intake manifold during rotation of the rotor pack;

a shaft supporting each of the first rotor and the second rotor within the enclosing case;

a relief zone disposed at an intake airflow side of the each lobe, wherein the relief zone allows-additional airflow to enter between the meshed lobes rather than the airflow being severed by leading edges of the lobes as the lobes become meshed; and wherein the relief zone comprises a curved surface that includes a line of curvature that is tangent to each of the flat end faces and is tangent to a trailing surface of the each lobe.

2. The rotor pack of claim 1, wherein the relief zone extends from a termination of a radial blend prior to a compression zone to a termination of a radial seal of the each lobe.

3. The rotor pack of claim 2, wherein the compression zone comprises a valley that is disposed between adjacent pairs of lobes comprising each of the first rotor and the second rotor.

4. The rotor pack of claim 1, further including a cupped portion comprising an intake side of each of the first rotor and the second rotor.

5. The rotor pack of claim 4, wherein the cupped portion comprises a triangular-shaped region disposed on a leading surface of the each lobe.

6. The rotor pack of claim 4, wherein the cupped portion comprises a sharpened leading edge that transitions into flattened region of the each lobe.

7. The rotor pack of claim 6, wherein the flattened region extends to a trailing surface of the each lobe.

8. The rotor pack of claim 6, wherein the sharped leading edge and the flattened region are configured to scoop additional airflow into a rotor cavity during operation of the first rotor and the second rotor.

9. The rotor pack of claim 1, further including an angled portion disposed on the each lobe adjacent to a rotor bearing plate.

10. The rotor pack of claim 9, wherein the angled portion is disposed between a trailing surface and a flat face of the each lobe.

11. The rotor pack of claim 10, wherein the angled portion reduces a margin of the each lobe to a sharpened edge without affecting the overall diameter of the margin.

12. The rotor pack of claim 1, further including a pressure relief portion comprising a rotor bearing plate and configured to extend a compression event during operation of the rotor pack.

13. The rotor pack of claim 12, wherein the pressure relief portion is configured to direct air out from between the first rotor and the second rotor in an efficient manner that minimizes turbulence.

14. The rotor pack of claim 12, wherein the pressure relief portion is configured to relieve pressure from between the first rotor and the second rotor.

15. The rotor pack of claim 12, wherein the pressure relief portion is configured to improve airflow away from the rotors pack during the compression event.

16. The rotor pack of claim 1, further including tapered radius portions comprising the enclosing case that are configured to allow additional airflow into between first rotor and the second rotor.

17. The rotor pack of claim 16, wherein the tapered radius portion are configured to allow air that is dragged by the first rotor and the second rotor to enter between the first rotor and the second rotor.

* * * * *